US007650089B2

(12) United States Patent
Borton et al.

(10) Patent No.: US 7,650,089 B2
(45) Date of Patent: Jan. 19, 2010

(54) SYSTEM FOR MEASURING AND CONTROLLING TOTAL COLOR OF A MIXTURE OF COLORANTS SUCH AS TONER

(75) Inventors: Michael D. Borton, Ontario, NY (US); R Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 471 days.

(21) Appl. No.: 11/598,512

(22) Filed: Nov. 13, 2006

(65) Prior Publication Data

US 2008/0112730 A1 May 15, 2008

(51) Int. Cl.
*G03G 15/00* (2006.01)
*G03G 15/01* (2006.01)
*G03G 15/08* (2006.01)

(52) U.S. Cl. ..... 399/28; 399/74; 399/223

(58) Field of Classification Search ..... 399/27, 399/28, 30, 58, 61, 62, 64, 74, 223
See application file for complete search history.

(56) References Cited

U.S. PATENT DOCUMENTS 5,781,828 A 7/1998 Caruthers, Jr. et al.
5,899,605 A * 5/1999 Caruthers et al. ..... 399/223
6,289,184 B1 * 9/2001 Yoo et al. ..... 399/64
6,575,096 B1 6/2003 Caruthers et al.
6,931,219 B2 8/2005 Vitturro et al.
6,993,272 B2 1/2006 Lange et al.
7,212,752 B2 * 5/2007 Hirota et al. ..... 399/27
2006/0127110 A1 6/2006 Borton et al.

* cited by examiner

*Primary Examiner*—William J Royer
(74) *Attorney, Agent, or Firm*—Pillsbury Winthrop Shaw Pittman LLP

(57) ABSTRACT

A developer unit used in xerographic printing retains a mixture of at least a first colorant and a second colorant. An illuminator directs toward at least a portion of the mixture a first light of one color, a second light of a second color, and a third light substantially outside of a visible range. A photosensor records a first reflectance signal based on light reflected from the mixture substantially in a visible range, and a second reflectance signal based on light reflected from the mixture substantially outside a visible range. The signals can be used to maintain the mixture at the desired total color and other properties.

20 Claims, 3 Drawing Sheets

FIG. 2
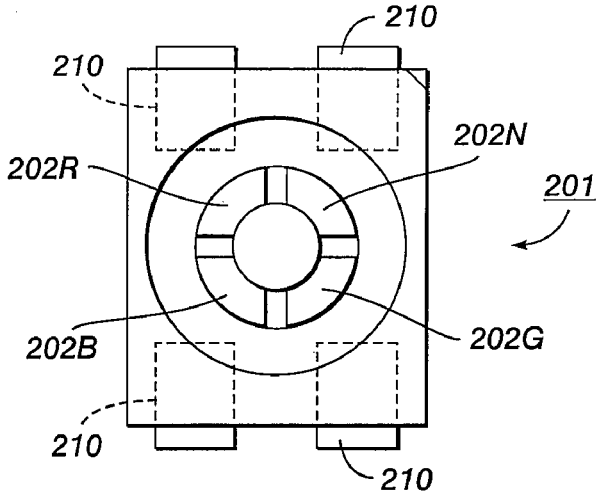
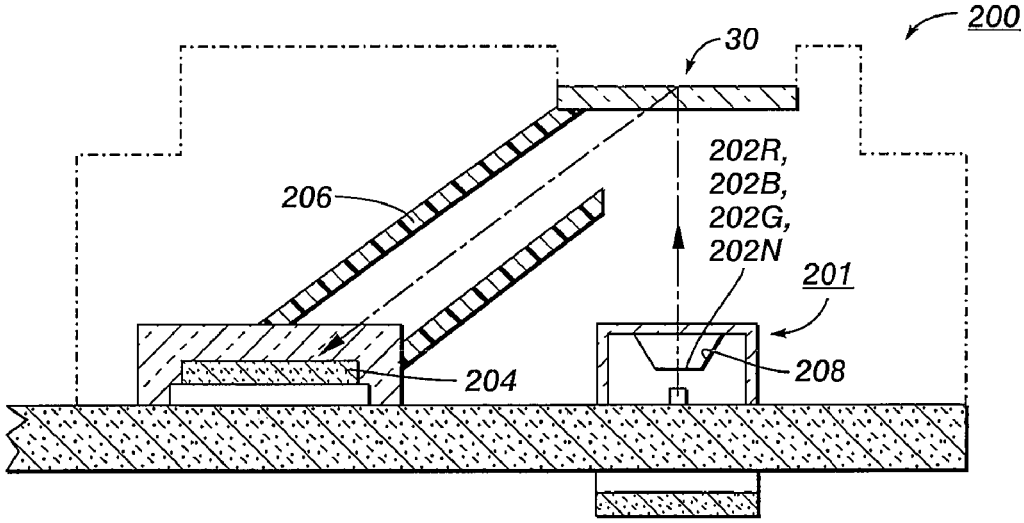
FIG. 3

SYSTEM FOR MEASURING AND CONTROLLING TOTAL COLOR OF A MIXTURE OF COLORANTS SUCH AS TONER

INCORPORATION BY REFERENCE

The following documents are incorporated by reference in their entireties for the teachings therein: U.S. Pat. Nos. 6,993,272 and 6,931,219, and U.S. Patent Application Publication 2006/0127110.

TECHNICAL FIELD

The present disclosure relates to electrostatographic or xerographic printing, and in particular to obtaining desired colors in xerographic printing through mixing of primary-color toners.

BACKGROUND

In high-volume xerographic printing, it has recently become of interest to provide "custom color" options, in which a dedicated developer unit dispensing toner of a very specific color is provided. A custom color is typically desired by a customer using a characteristic, and sometimes proprietary, color for letterheads and other purposes. In one business model, a printing or supplies vendor blends two or more commercially-available component color toners to obtain a mixture having the specific desired color. The mixture is then used directly in a single developer unit, along with the standard black developer unit, within a highlight-color printing apparatus or in a "fifth housing" in a full-color printing apparatus.

In a practical application of a custom color xerographic system, the use of a mixture of color toners in a single developer unit presents certain challenges. Most notably, different types of toner, such as corresponding to different component colors, may be electrostatically drawn from the developer unit at different rates:

unchecked a "faster-going" type of toner will be drawn out of the developer unit toward a photoreceptor at a high rate toward the beginning of use, leaving a high concentration of a "slower-going" toner (of a different color) in the developer unit. In short, the use of a mixture of toners can cause a drift of the actual color produced by the developer unit over time. Further, the two types of toner may have significantly different electrostatic properties, and the single developer unit may be controlled assuming a set of electrostatic properties of the predetermined original mixture: as the relative concentration of the two types of toner drifts away from that of the original mixture, electrostatic control of the unit, even with feedback control, becomes uncertain.

An optical approach for sensing toner concentration has been used in a broad range of noises and under machine operating conditions. However, for sensing of mixtures of toners of different types, using a single LED emission wavelength cannot provide color information. This sensing approach uses the fact that the color of the developer, i.e., its L*a*b* values, monotonically increases or decreases as a function of increasing or decreasing concentration of the toner mixture and of the constituents of the mixture. A spectrophotometer based device can provide the same information, but this approach has some shortcomings, such as a need for a broad band white light source, and a network of fiber optics to transmit the signal to and from the various color-toner sumps within a printing apparatus.

This disclosure proposes an optical toner concentration sensor that provides an alternative to the spectrophotometer.

The two patent documents incorporated by reference above demonstrate the overall strategy of using and controlling a custom-color developer unit with a powdered-toner mixture. U.S. Pat. Nos. 5,781,828 and 6,575,096 describe a color control system for xerography using toners suspended in liquids.

SUMMARY

According to one aspect, a printing apparatus comprises a developer unit retaining a mixture of at least a first colorant, having a first component color, and a second colorant, having a second component color. An illuminator directs toward at least a portion of the mixture a first light of a first predetermined color, a second light of a second predetermined color, and a third light of a third predetermined color, the third predetermined color being substantially outside of a visible range. A photosensor records a first reflectance signal based on light reflected from the mixture substantially in a visible range, and a second reflectance signal based on light reflected from the mixture substantially outside a visible range.

BRIEF DESCRIPTION OF THE DRAWINGS

FIG. 2 is a plan view and FIG. 3 is a side view of an illuminator-photosensor package.

DETAILED DESCRIPTION

Figure 1:
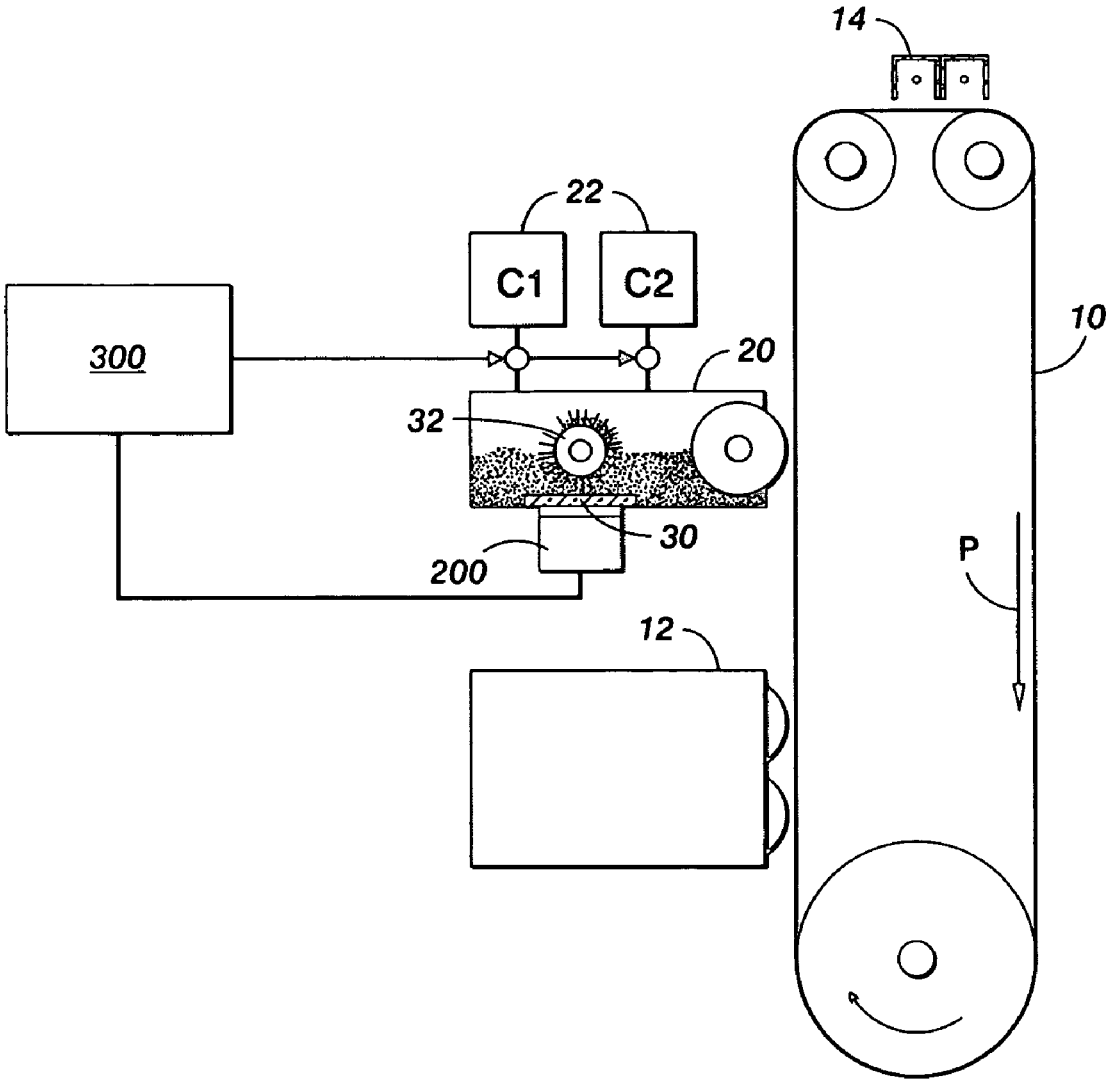
FIG. 1 is a simplified diagram of a "custom color" xerographic printing apparatus.

FIG. 1 is a simplified diagram of a "custom color" xerographic printing apparatus, capable of printing images in two colors, such as black and a custom color. As is familiar in xerography, there is provided a belt photoreceptor 10, entrained around rollers and rotatable in process direction P. At fixed locations are provided a black developer unit 12, and a custom color developer unit 20, which will be described in detail below. Images developed in black and in the custom color on photoreceptor 10 are transferred at a transfer station 14 to a print sheet. Other elements familiar in xerography, such as charging, exposure, and cleaning devices, are not shown.

Turning to custom color developer unit 20, a main housing is used to mix, in this embodiment, two primary color toners (component colorants) to obtain a desired custom color that will be used to develop the suitably-charged surfaces of photoreceptor 10. Although a system with two component colorants is shown in the illustrated embodiment, other embodiments with three or more mixable component colorants are possible. As mentioned above, in order to maintain the desired custom color within developer unit 20, the two component colorants must be maintained in a predetermined proportion over time while the printer is running. In order to admix extra amounts of each component colorant as needed to the housing of developer unit 20, there are provided distinct component colorant supplies 22, one for each component colorant, and labeled C1 and C2. Each component colorant supply 22 comprises some sort of container for its component colorant, as well as a mechanism for outputting a predetermined amount of the component colorant into developer unit 20 upon an external request; such mechanisms are known in the art.

Associated with the housing of developer unit 20 is what can generally be called an "illuminator-photosensor" 200, which is associated with a control system 300 that ultimately controls the amount of component colorant C1 or C2 output by each component colorant supply 22. Illuminator-photosensor 200 is placed adjacent to a light-transmissive window 30 in developer unit 20 and is thus exposed to a well-mixed mixture of the two component colorants. The window 30 can be adjacent a mixing brush 32 or similar structure inside developer unit 20.

FIG. 2 is a plan view of an illuminator package 201 that can be used in illuminator-photosensor 200. A typical size of such an illuminator package 201 is about 3 mm per side. The illuminator-photosensor 200 includes a plurality of color-specific light sources 202R, 202B, 202G, and 202N, which selectably emit light in predetermined ranges of red (600-700 nm), blue (400-500 nm), green (500-600 nm), and neutral wavelengths, respectively. In one embodiment the "neutral" color is infrared, about 940 nm. The light sources 202R, 202B, 202G encompass the entire visible spectrum, or at least a portion of the spectrum as large as a possible gamut of colors obtainable by various combinations of component colorants C1 and C2. In order to expand the sensed color gamut, additional light sources of wavelength of interest can be integrated in the illuminator package 201.

The light sources 202R, 202B, 202G, and 202N are disposed at the bottom of a cavity 208 shaped like a truncated cone. Also associated with light sources 202R, 202B, 202G, and 202N are any number of terminals 210.

FIG. 3 is a side view of the illuminator-photosensor 200. Photosite 204 is disposed at the end of an angled channel 206, and thus oriented relative to the light sources 202R, 202B, 202G, and 202N such that it will receive only diffuse light reflected from the developer mixture through window 30. The photosite 204 includes an electronic element having a photosensitive surface, such as a Si-photodiode detector. The arrangement of this embodiment is useful for ensuring light from a selected light source 202R, 202B, 202G, or 202N is reflected from the window 30 associated with developer unit 20 and the reflected light is detected at photosite 204.

According to one practical embodiment, when it is desired to determine accurately the color of the mixed component colorants within developer unit 20 at a given time, each of the plurality of light sources such as 202R, 202B, 202G, and 202N is sequentially "lit up" for a brief predetermined period and the reflection response for each color is recorded sequentially at photosite 204. In one practical embodiment, the light-up period is about one half second for each light sources 202R, 202B, 202G, and 202N, but the period can be varied, typically depending on the rotational speed of augers or mixing brush 32 within the developer unit 20.

Figure 4:
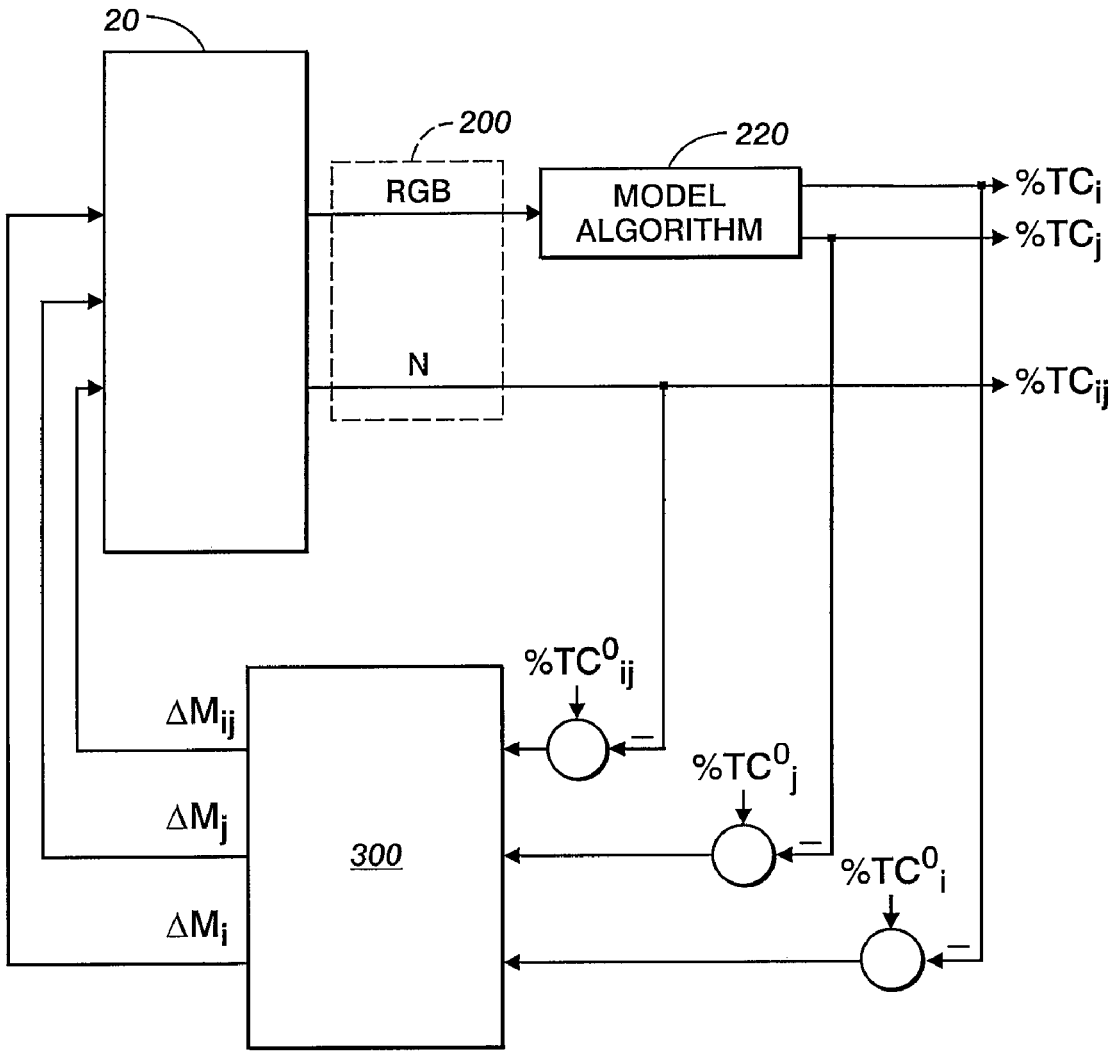
FIG. 4 is a diagram of a feedback system according to one embodiment.

FIG. 4 is a diagram of a feedback system according to one embodiment. Illuminator-photosensor 200 establishes reflectivity values for a developer mixture of several toners in developer unit 20. The reflectivity signals in the RGB channels, i.e., the reflectivity of the developer mixture when reflecting light from sources 202R, 202B, and 202G, are submitted to a "model" algorithm 220, which converts the signals to TC values corresponding to each component colorant C1 and C2. (As used herein, the term "TC" refers in this embodiment to a % TC, or percentage of toner to carrier, but can refer to any datum, such as toner-to-carrier ratio, toner-to-total-developer ratio, or any other value, for any purpose, in which relative amounts of toner and carrier are significant components.) Simultaneously, the reflectivity related to the neutral or infrared channel (relating to source 202N) is used to derive a TC value, which relates to the TC of the total mixture.

In one embodiment, the model algorithm 220 establishes the relationship between the optical response of the illuminator-photosensor 200 and the TC. The optical responses are given by the following equations:

$$V_i^{PD} = C_i \times \int_{\lambda_0^i}^{\lambda_1^i} S_{PD} \times E_i \times R_d \, d\lambda \qquad \text{equation (1)}$$

And the total response is given by:

$$V_i^{PD} = C_t \times \int_{\lambda_0^t}^{\lambda_1^t} S_{PD} \times E_t \times R_d \, d\lambda \qquad \text{Equation (2)}$$

Where i=LED (R, G, B, etc.)

t=LED(IR)

$S_{PD}$ is the normalized spectral responsivity of photosite 204

E is the normalized spectral density of the LED $R_d$ is the diffuse reflectivity spectra of the developer $V^{PD}{}_i$ is the optical response of the developer measured using LED illuminant i $V^{PD}{}_t$ is the optical response of the developer measured by using LED illuminant t $C_i$ and $C_t$ are constants containing (a) optical path factors, (b) peak responsivity of the photosite 204, and (c) peak responsivity of each LED 202R, 202B, 202G, and 202N.

In referenced U.S. Pat. No. 6,931,219 it is shown how to obtain conversion factors from optical responses to $TC_i$ and $TC_t$, for equations (1) and (2) for developer of single color toners. For developer mixtures it is required to measure the responses for several regions of the optical spectrum. Here we use selected colors, e.g., RGB illuminants. One embodiment involves the transformation to device independent color space, i.e., Lab CIE, to process the optical responses of the mixture. For example, using the Lab CIE color space, a usual transformation from RGB to Lab CIE involves a matrix transformation of the type:

$$\begin{bmatrix} L^* \\ a^* \\ b^* \end{bmatrix} \approx A \times \begin{bmatrix} R \\ G \\ B \end{bmatrix} \qquad \text{equation (3)}$$

Where R G B are the optical responses measured by the RGB illuminants, respectively, L*a*b* are the CIE color space values of the sample, and A is a 3×3 matrix with coefficients $a_{ij}$ determined experimentally from measurements of TC calibrated samples using a spectrophotometer. Another embodiment uses directly the measured RGB values to map the TC of the sample. The values of the responses are uniquely determined by the TC of the developer sample, provided that the chemical and physical compositions of the constituent toners and carriers are not changed. Otherwise, a new set of calibration coefficients has to be determined.

Further as shown in FIG. 4, the values of TC derived for each response $V^{PD}{}_i$, as well as the total TC derived from the IR response, $V^{PD}{}_t$, is compared to a desired level, and the comparison is used in control system 300 to admix toner of one or another type through component colorant supplies 22, as shown in FIG. 1.

The following example illustrates how measurements using selected illuminants, e.g., RGB colors, can be used to measure properties of a mixture of a generally green custom color.

The spectra of a desired green developer (mix of cyan and yellow toners) contain elements of both cyan and yellow responses. By inspection, the blue LED (470 nm) has small response for yellow and maximum response for cyan, whereas for green (565 nm) and red (660 nm) LEDs the situation is reversed. The relationship between the optical response of the mixture and those of the constituents is given by adding the absorbances of the optical responses of the constituent toners. However, in first approximation, and for small TC changes around a given target TC, the optical response of the mixture and those of the constituents can be given by adding the optical responses of the constituent toners. In the following example we use the later approximation. Then, the optical response of a 50:50 mixture of cyan and yellow at 4.5% TC to render 4.5% TC green developer, can be approximately represented by the following relationships:

$$\begin{bmatrix} V_R^{PD}(\text{TC_green}) \\ V_G^{PD}(\text{TC_green}) \\ V_B^{PD}(\text{TC_green}) \end{bmatrix} \approx a_{cyan} \times \begin{bmatrix} V_R^{PD}(\text{TC_cyan}) \\ V_G^{PD}(\text{TC_cyan}) \\ V_B^{PD}(\text{TC_cyan}) \end{bmatrix} + b_{yellow} \times \begin{bmatrix} V_R^{PD}(\text{TC_yellow}) \\ V_G^{PD}(\text{TC_yellow}) \\ V_B^{PD}(\text{TC_yellow}) \end{bmatrix}, \quad \text{equation (4)}$$

In the equation, the coefficients $a_{cyan}$ and $b_{yellow}$ are determined experimentally.

Let $TC_0$_green=4.5% be the target TC value for the green developer, and TC_green be the actual optical response obtained from measurements using the IR illuminant ($V^{PD}_t$), e.g., TC_green=4.2%. This indicates a total TC deficit of 0.3%, and unknown deficits in the amounts of cyan and yellow toners. The TC of the cyan and yellow constituents of the green mixture are extracted from the responses [$V_{RGB}^{PD}$(TC_green)], using an error minimization fitting procedure and the relationship between TC and optical responses of the individual constituents. The minimization procedure provides actual values of [$V_{RGB}^{PD}$(TC_cyan)] and [$V_{RGB}^{PD}$(TC_yellow)]:

$$\begin{bmatrix} V_R^{PD}(\text{TC_cyan}) \\ V_G^{PD}(\text{TC_cyan}) \\ V_B^{PD}(\text{TC_cyan}) \end{bmatrix} \approx \begin{bmatrix} 0 \\ 0 \\ 0.95 \end{bmatrix}, \quad \text{equation (5a)}$$

$$\begin{bmatrix} V_R^{PD}(\text{TC_yellow}) \\ V_G^{PD}(\text{TC_yellow}) \\ V_B^{PD}(\text{TC_yellow}) \end{bmatrix} \approx \begin{bmatrix} 0.96 \\ 0.96 \\ 0 \end{bmatrix}, \quad \text{equation (5b)}$$

From these results, the following equations describing TC as a function of optical responses can be obtained. For illustration purposes, in these equations, some of the responses were approximated to zero. The actual values are not 0, but show only a small dependence on TC, as one can see from the cyan and yellow spectra, following the calibration reported in reference U.S. Pat. No. 6,931,219:

$$\%\ \text{TC_cyan (Red LED)} \sim 0, \quad \text{equation (6a)}$$

$$\%\ \text{TC_cyan (Green LED)} \sim 0, \quad \text{equation (6b)}$$

$$\%\ TC\text{_cyan (Blue LED)} = 7.17 * V_B^{PD} - 2.07, \quad \text{equation (6c)}$$

$$\%\ TC\text{_yellow (Red LED)} = 10.15 * V_R^{PD} - 5.39, \quad \text{equation (7a)}$$

$$\%\ TC\text{_yellow (Green LED)} = 10.15 * V_G^{PD} - 5.39, \quad \text{equation (7b)}$$

$$\%\ \text{TC_yellow (Blue LED)} \sim 0, \quad \text{equation (7c)}$$

For TC=4.5%, equation (1) and (4) gives for the target values of the responses of the primaries cyan and yellow $$\begin{bmatrix} V_R^{PD}(TC_0\text{_cyan}) \\ V_G^{PD}(TC_0\text{_cyan}) \\ V_B^{PD}(TC_0\text{_cyan}) \end{bmatrix} \approx \begin{bmatrix} 0 \\ 0 \\ 0.916 \end{bmatrix}, \quad \text{equation (9a)}$$

$$\begin{bmatrix} V_R^{PD}(TC_0\text{_yellow}) \\ V_G^{PD}(TC_0\text{_yellow}) \\ V_B^{PD}(TC_0\text{_yellow}) \end{bmatrix} \approx \begin{bmatrix} 0.974 \\ 0.974 \\ 0 \end{bmatrix}, \quad \text{equation (9b)}$$

The difference between target values, equations (9a-9b), and actual values, equations (6a-7c), provides a measure of the error that is translated into ΔTC for used in the controller. Then, for this simplified case, there is obtained:

$$\Delta\text{TC_cyan} = 0.24\%,$$

$$\Delta\text{TC_yellow} = -0.14\%,$$

These values are processed by a controller of, e.g., integrator type, to obtain the masses of cyan and yellow to be dispensed to adjust the ratio of cyan:yellow and the total TC_green of the developer unit 20. The particular controller design may be of different types, and could have different gains, based on the actual rate of change of the TC.

Although the above description is directed to a xerographic system using mixtures of powdered colorants, the description can be applied to printing systems of any type in which the colorants are to some extent in liquid or suspension form. As such, the term "developer unit" can apply not only to electrostatographic systems, but to any container in any type of printing system (such as offset or ink-jet), in which component colorants are mixed to obtain a predetermined target color.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A printing apparatus, comprising a developer unit configured to retain a mixture of at least a first colorant, having a first component color, and a second colorant, having a second component color;

an illuminator configured to direct, toward at least a portion of the mixture, a first light of a first predetermined color, a second light of a second predetermined color, and a third light of a third predetermined color, the third predetermined color being substantially outside of a visible range; and a photosensor configured to record a first reflectance signal based on light reflected from the mixture substantially in a visible range, and a second reflectance signal based on light reflected from the mixture substantially outside a visible range.

2. The apparatus of claim 1, wherein the illuminator is configured to cause the directing of the first light and the directing of the second light to occur sequentially.

3. The apparatus of claim 1, wherein the illuminator comprises at least a first LED emitting the first light and a second LED emitting the second light.

4. The apparatus of claim 1, wherein the third light is substantially infrared.

5. The apparatus of claim 1, further comprising an admixer configured to selectably add to the developer unit predetermined amounts of either the first colorant or the second colorant.

6. The apparatus of claim 5, wherein the admixer is configured to add to the developer unit predetermined amounts of the first colorant and the second colorant in a predetermined ratio.

7. The apparatus of claim 5, further comprising a control system associated with the photosensor and the admixer.

8. The apparatus of claim 7, wherein the control system is configured to operate to obtain a predetermined target TC for the mixture.

9. The apparatus of claim 1, wherein the illuminator is configured to direct, toward at least a portion of the mixture, a fourth light of a fourth predetermined color.

10. The apparatus of claim 9, wherein the first, second, and fourth colors substantially correspond to primary visible colors.

11. A method for printing comprising:

retaining, in a developer unit, a mixture of at least a first colorant, having a first component color, and a second colorant, having a second component color;

directing, via an illuminator, toward at least a portion of the mixture, a first light of a first predetermined color, a second light of a second predetermined color, and a third light of a third predetermined color, the third predetermined color being substantially outside of a visible range; and recording, via a photosensor, a first reflectance signal based on light reflected from the mixture substantially in a visible range, and a second reflectance signal based on light reflected from the mixture substantially outside a visible range.

12. The method of claim 11, further comprising causing the directing of the first light and the directing of the second light, via the illuminator, to occur sequentially.

13. The method of claim 11, wherein the illuminator comprises at least a first LED emitting the first light and a second LED emitting the second light.

14. The method of claim 11, wherein the third light is substantially infrared.

15. The method of claim 11, further comprising selectably adding to the developer unit, via an admixer, predetermined amounts of either the first colorant or the second colorant.

16. The method of claim 15, further comprising adding to the developer unit, via the admixer, predetermined amounts of the first colorant and the second colorant in a predetermined ratio.

17. The method of claim 15, further comprising providing a control system associated with the photosensor and the admixer.

18. The method of claim 17, further comprising obtaining, via the control system, a predetermined target TC for the mixture.

19. The method of claim 11, further comprising directing, via the illuminator, toward at least a portion of the mixture, a fourth light of a fourth predetermined color.

20. The method of claim 19, wherein the first, second, and fourth colors substantially corresponding to primary visible colors.

* * * * *